US006162772A

United States Patent [19]

Dounis

[11] Patent Number: 6,162,772

[45] Date of Patent: Dec. 19, 2000

[54] OIL ADDITIVES AND COMPOSITIONS

[75] Inventor: Panagiotis Dounis, Oxon, United Kingdom

[73] Assignee: Infineum USA L.P., Linden, N.J.

[21] Appl. No.: 09/377,378

[22] Filed: Aug. 19, 1999

[30] Foreign Application Priority Data

Aug. 20, 1998 [GB] United Kingdom ..... 9818210

[51] Int. Cl.[7] ..... C10M 145/02; C10M 157/00; C10L 1/18

[52] U.S. Cl. ..... 508/583; 508/475; 508/451; 508/591; 44/393; 44/451

[58] Field of Search ..... 508/591, 583

[56] References Cited

U.S. PATENT DOCUMENTS

| | | | |
|---|---|---|---|
| 3,635,685 | 1/1972 | Sonnenfeld . | |
| 4,021,207 | 5/1977 | Durand et al. | 44/62 |
| 4,032,459 | 6/1977 | Crossland et al. | 252/51.5 A |
| 4,367,074 | 1/1983 | Maldonado et al. | 44/62 |
| 5,242,989 | 9/1993 | Bening et al. | 525/384 |
| 5,264,480 | 11/1993 | Bening et al. | 524/505 |
| 5,300,586 | 4/1994 | Bening et al. | 525/332.8 |
| 5,310,490 | 5/1994 | Struglinski et al. | 252/43 |
| 5,310,814 | 5/1994 | Struglinski et al. | 525/314 |
| 5,356,970 | 10/1994 | Bening et al. | 525/164 |
| 5,525,128 | 6/1996 | McAleer et al. | 44/459 |
| 5,543,469 | 8/1996 | Struglinski et al. | 525/314 |
| 5,945,485 | 8/1999 | Struglinski et al. | 525/314 |

FOREIGN PATENT DOCUMENTS

| | | |
|---|---|---|
| 1490563 | 11/1977 | United Kingdom . |
| 2095698 | 10/1982 | United Kingdom . |

*Primary Examiner*—Ellen M. McAvoy

[57] ABSTRACT

Use of a hydrogenated diene polymer with a polar group to improve cold flow improver adpack compatibility.

43 Claims, No Drawings

OIL ADDITIVES AND COMPOSITIONS

This invention relates to oil compositions, primarily to fuel oil compositions, and more especially to fuel oil compositions susceptible to wax formation at low temperatures, to additives for use in such fuel oil compositions, and to the use of the additives to improve the cold flow properties of fuels.

Fuel oils, whether derived from petroleum or from vegetable sources, contain components, e.g., alkanes, that at low temperature tend to precipitate as large crystals or spherulites of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallizes as platelets; certain additives inhibit this and cause the wax to adopt an acicular habit, the resulting needles being more likely to pass through a filter than are platelets. The additives may also have the effect of retaining in suspension in the fuel the crystals that have formed, the resulting reduced settling also assisting in prevention of blockages.

It has previously been proposed, for example in British Specification No. 1 490 563, to use a hydrogenated diene polymer, e.g., a homopolymer of butadiene or a copolymer of butadiene with a $C_5$ to $C_8$ diene, especially isoprene, as a cold flow improver. It has also been proposed to use a hydrocarbon wax to the same end. It is common practice to include hydrocarbon polymers, or hydrocarbon-unsaturated ester copolymers, especially ethylene-vinyl acetate copolymers, for the purpose, and it is further common to employ two or more cold flow improvers, such mixtures showing synergy.

Unfortunately, it has been found that when two or more cold flow improvers are mixed at high concentrations in a solvent medium, as in an additive concentrate or "adpack", they may be incompatible, the solution not being stable over a prolonged period. This problem has proved especially severe when hydrogenated diene polymers and ethylene-unsaturated ester polymers are present in the same package, certain combinations producing sediment after storage for only one day at room temperature.

The present invention is based on the observation that the inclusion of a polar group, advantageously a terminal polar group, in the hydrogenated diene polymer improves its compatibility in multi-component cold flow additive packages.

The present invention accordingly provides a cold flow improver composition comprising (i) a hydrogenated diene polymer having a polar group and (ii) a cold flow improver other than a polymer (i).

Advantageously, the hydrogenated diene polymer is an oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations.

Advantageously, the hydrogenated block copolymer used in the present invention comprises at least one substantially linear crystallizable segment or block and at least one segment or block that is essentially not crystallizable. Without wishing to be bound by any theory, it is believed that when butadiene is homopolymerized with a sufficient proportion of 1,4 (or end-to-end) enchainments to provide a substantially linear polymeric structure then on hydrogenation it resembles polyethylene and crystallizes rather readily; when a branched diene is polymerized on its own or with butadiene a branched structure will result (e.g., a hydrogenated polyisoprene structure will resemble an ethylene-propylene copolymer) that will not readily form crystalline domains but will confer fuel oil solubility on the block copolymer.

Advantageously, the block polymer before hydrogenation comprises units derived from butadiene only or from butadiene and at least one comonomer of the formula $$CH_2{=}CR^1{-}CR^2{=}CH_2$$

wherein $R^1$ represents a $C_1$ to $C_8$ alkyl group and $R^2$ represents hydrogen or a $C_1$ to $C_8$ alkyl group. Advantageously the total number of carbon atoms in the comonomer is 5 to 8, and the comonomer is advantageously isoprene. Advantageously, the copolymer contains at least 10% by weight of units derived from butadiene.

After hydrogenation, the copolymer advantageously contains at least 10%, preferably at least 20%, and most preferably from 25 to 60%, by weight of at least one crystalline or crystallizable segment composed primarily of methylene units; to this end the crystallizable segment before hydrogenation advantageously has an average 1,4 or end-to-end enchainment of at least 70 preferably at least 85, mole per cent. The hydrogenated block copolymer comprises at least one low crystallinity (or difficultly crystallizable) segment composed of methylene and substituted methylene units, derived from one or more alkyl-substituted monomers described above, e.g., isoprene and 2,3-dimethylbutadiene.

Alternatively, the low crystallinity segment may be derived from butadiene by 1,2 enchainment, in which the segment has before hydrogenation an average 1,4 enchainment of butadiene of at most 60, preferably at most 50, percent. As a result, the polymer comprises 1,4-polybutadiene as one block and 1,2-polybutadiene as another. Such polymers are obtainable by, e.g., adding a catalyst modifier, as described in International Application WO92/16568, the disclosure of which is incorporated herein by reference.

A further advantageous block copolymer is a hydrogenated tapered block or segmented copolymer, advantageously of butadiene and at least one other conjugated diene, preferably isoprene. Such a block copolymer may be obtained by anionically copolymerizing in hydrocarbon solution in, for example, a batch reactor, a mixture containing butadiene monomer and at least one other conjugated diene monomer to form a precursor copolymer having at least 75 weight percent 1,4-configuration of the butadiene and at least one other conjugated diene and then hydrogenating said precursor copolymer.

During the initial formation of the unhydrogenated precursor copolymer of butadiene and at least one other conjugated diene, butadiene will be preferentially polymerized. The concentration of monomers in solution changes during the course of the reaction in favour of the other conjugated diene as the butadiene is depleted. The result is a precursor copolymer in which the copolymer chain is higher in butadiene concentration in the chain segments grown near the beginning of the reaction and higher in the other conjugated diene concentration in the chain segments formed near the end of the reaction. These copolymer chains are accordingly described as tapered in composition. Upon hydrogenation the butadiene rich portion of the polymer becomes rich in methylene units. Therefore, in each of these hydrogenated generally linear copolymer molecules two longitudinal segments are present, gradually merging into each other without sharp boundaries. One of the outer segments consists nearly completely of methylene units derived from the hydrogenation of the butadiene in the 1,4-configuration and contains only small amounts of substituted methylene units derived from the hydrogenation of the other conjugated diene such as isoprene. The second segment is relatively rich in substituted methylene units derived, for example, from the hydrogenation of the isoprene in the 1,4-configuration. The first segment, which is rich in methylene units, comprises the crystallizable segment, advantageously containing more than 20 mole percent 1,4-polybutadiene. The second outer segment comprises the low crystallinity segment, advantageously containing less than 20 mole percent 1,4-polybutadiene units. In these tapered block copolymers the crystallizable segment typically comprises an average of at least 20 mole percent of the copolymer's chain.

The weight percent of the butadiene present in the reaction mixture is that effective to form a tapered segmented or block copolymer having at least one crystallizable block and at least one non-crystallizable block. Generally this amount of butadiene is from 20 to 90 weight percent. Additionally, the proportion of the 1,4-configuration butadiene present in the precursor copolymer is that effective to form a crystallizable segment upon hydrogenation of the precursor copolymer. Generally, this proportion is at least 80 weight percent.

A further advantageous block copolymer is a star copolymer having from 3 to 25, preferably 5 to 15, arms.

Advantageous embodiments of block copolymers are those comprising a single crystallizable block and a single non-crystallizable block and those comprising a single non-crystallizable block having at each end a single crystallizable block. Other tri- and tetra-block copolymers are also suitable.

In general, the crystallizable block or blocks will be the hydrogenation product of the unit resulting from predominantly 1,4- or end-to-end polymerization of butadiene, while the non-crystallizable block or blocks will be the hydrogenation product of the unit resulting from 1,2-polymerization of butadiene or from 1,4-polymerization of an alkyl-substituted butadiene.

Advantageously the molecular weight, Mn, of the hydrogenated block copolymer, measured by GPC, lies in the range of 500 to 100,000, more advantageously 500 to 20,000, preferably 500 to 10,000 and more preferably from 3,000 to 8,000.

Advantageously, in a diblock polymer, the molecular weight of the crystallizable block is from 500 to 20,000, and preferably from 500 to 5,000, and that of the non-crystallizable block is from 500 to 50,000, preferably from 1,000 to 5,000. In a triblock polymer, the molecular weight of each crystallizable block is advantageously from 500 to 20,000, advantageously about 5,000, and that of the non-crystallizable block is from 1,000 to 20,000, preferably 1,000 to 5,000.

The proportion of the total molecular weight of a block copolymer represented by a crystalline block or blocks may be determined by H or C NMR, and the total molecular weight of the polymer by GPC.

As indicated in more detail in International Application WO92/16567, the disclosure of which is incorporated herein by reference, the precursor block copolymers are conveniently prepared by anionic polymerization, which facilitates control of structure and molecular weight, preferably using a metallic or organometallic catalyst. Hydrogenation is effected employing conventional procedures, using elevated temperature and hydrogen pressure in the presence of a hydrogenation catalyst, preferably palladium on barium sulphate or calcium carbonate or nickel octanoate/triethyl aluminium.

Advantageously, at least 90% of the original unsaturation (as measured by NMR spectroscopy) is removed on hydrogenation, preferably at least 95%, and more preferably at least 98%.

The polar group in the hydrogenated diene polymer may be, for example a hydroxy or carboxy group.

The polar group is advantageously present in a molar proportion of 0.4 to 2, preferably 0.6 to 1.5, and more preferably 0.8 to 1.2, groups per polymer molecule. In general, the polar groups are advantageously predominantly primary, i.e., terminal, groups.

The polar group may be introduced into the diene polymer, either after but preferably before hydrogenation, by a method appropriate to the polar group concerned. For example, a hydroxy group may be introduced just before completion of polymerization by reaction with ethylene or propylene oxide in the presence of a basic catalyst (e.g., lithium hydroxide) and subsequent reaction with a proton donor (e.g., a carboxylic acid) to form the hydroxide, or by the ethylene oxide treatment described in U.S. Pat. No. 3,135,716, the entire disclosure of which is incorporated by reference herein. A further method for introducing a hydroxy group is by polymerizing in the presence of a peroxide, e.g., hydrogen peroxide, as described in U.S. Pat. No. 3,446,740, the disclosure of which is incorporated by reference herein. The hydroxy group may, in turn, provide a site for further reaction to yield other polar groups which may improve compatibility or confer other characteristics on the polymer.

A carboxy group may be introduced by treatment of the polymer with $CO_2$, also as described in U.S. Pat. No. 3,135,716, and if desired may, in the same way as the hydroxy group, be used as a further reaction site.

In U.S. Pat. No. 3,446,740 there is disclosed the use of a hydrogenated diene polymer containing hydroxyl groups as a cold flow improver. U.S. Pat. No. 3,635,685 discloses a hydrogenated butadiene-styrene copolymer with hydroxyl, carboxyl and pyridyl groups for the same purpose. In each case, the hydrogenated polymer is the sole cold flow improver present.

As examples of cold flow improvers other than a polymer as defined in (i) there may be mentioned (A) ethylene-unsaturated ester compounds, (B) comb polymers, (C) polar nitrogen compounds, (D) hydrocarbon polymers, (E) hydrocarbyl esters of amine-substituted carboxylic acids, (F) poly(meth)acrylate esters, (G) polyoxyalkylene compounds, and (H) a mixture of saturated hydrocarbons, at least some of which have a number of carbon atoms within the range of 15 to 60, the components A to H being other than a component as defined in (i).

In the preferred embodiments of the invention, component (ii) may be:

A) an ethylene-unsaturated ester copolymer, more especially one having, in addition to units derived from ethylene, units of the formula $$—CR^3R^4—CHR^5—$$

wherein $R^3$ represents hydrogen or methyl, $R^4$ represents $COOR^6$, wherein $R^6$ represents an alkyl group having from 1 to 9 carbon atoms, which is straight chain or, if it contains 3 or more carbon atoms, branched, or $R^4$ represents $OOCR^7$, wherein $R^7$ represents $R^6$ or H, and $R^5$ represents H or $COOR^6$.

These may comprise a copolymer of ethylene with an ethylenically unsaturated ester, or derivatives thereof. An example is a copolymer of ethylene with an ester of a saturated alcohol and an unsaturated carboxylic acid, but preferably the ester is one of an unsaturated alcohol with a saturated carboxylic acid. An ethylene-vinyl ester copolymer is advantageous; an ethylene-vinyl acetate, ethylene-vinyl propionate, ethylene-vinyl hexanoate, or ethylene-vinyl octanoate copolymer is preferred.

As disclosed in U.S. Pat. No. 3,961,916, flow improver compositions may comprise a wax growth arrestor and a nucleating agent. Without wishing to be bound by any theory, the applicants believe that component (i) of the additive composition of the invention acts primarily as a nucleator and will benefit from the presence of an arrestor. This may, for example, be an ethylene-unsaturated ester as described above, especially an EVAC with a molecular weight (Mn, measured by gel permeation chromatography against a polystyrene standard) of at most 14000, advantageously at most 10000, preferably 2000 to 6000, and more preferably from 2000 to 5500, and an ester content of 7.5% to 35%, preferably from 10 to 20, and more preferably from 10 to 17, molar percent.

It is within the scope of the invention to include an additional nucleator, e.g., an ethylene-unsaturatedester, especially vinyl acetate, copolymer having a number average molecular weight in the range of 1200 to 20000, and a vinyl ester content of 0.3 to 10, advantageously 3.5 to 7.0 molar per cent.

(B) A comb polymer.

Such polymers are discussed in "Comb-Like Polymers. Structure and Properties",N. A. Platé and V. P. Shibaev, J. Poly. Sci. Macromolecular Revs., 8, p 117 to 253 (1974).

Advantageously, the comb polymer is a homopolymer having, or a copolymer at least 25 and preferably at least 40, more preferably at least 50, molar per cent of the units of which have, side chains containing at least 6, and preferably at least 10, atoms.

As examples of preferred comb polymers there may be mentioned those of the general formula

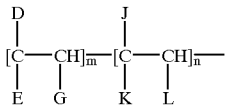

wherein $D=R^{11}$, $COOR^{11}$, $OCOR^{11}$, $R^{12}COOR^{11}$, or $OR^{11}$,

E=H, $CH_3$, D, or $R^{12}$,

G=H or D

J=H, $R^{12}$, $R^{12}COOR^{11}$, or an aryl or heterocyclic group,

K=H, $COOR^{12}$, $OCOR^{12}$, $OR^{12}$, or COOH,

L=H, $R^{12}$, $COOR^{12}$, $OCOR^{12}$, COOH, or aryl, $R^{11} \geqq C_{10}$ hydrocarbyl, $R^{12} \geqq C_1$ hydrocarbyl or hydrocarbylene, and m and n represent mole ratios, m being within the range of from 1.0 to 0.4, n being in the range of from 0 to 0.6. $R^{11}$ advantageously represents a hydrocarbyl group with from 10 to 30 carbon atoms, while $R^{12}$ advantageously represents a hydrocarbyl or hydrocarbylene group with from 1 to 30 carbon atoms.

The comb polymer may contain units derived from other monomers if desired or required. It is within the scope of the invention to include two or more different comb copolymers.

These comb polymers may be copolymers of maleic anhydride or fumaric acid and another ethylenically unsaturated monomer, e.g., an Ó-olefin or an unsaturated ester, for example, vinyl acetate. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, 1-tetradecene, 1-hexadecene, and 1-octadecene.

The copolymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol, 2-methyltridecan-1-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers such for example as those described in EP-A-153176, 153177 and 225688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight.

Other suitable comb polymers are the polymers and copolymers of Ó-olefins and esterified copolymers of styrene and maleic anhydride, and esterified copolymers of styrene and fumaric acid; mixtures of two or more comb polymers may be used in accordance with the invention and, as indicated above, such use may be advantageous.

(C) An ionic or non-ionic polar nitrogen compound.

Such compounds, which are oil-soluble, advantageously include at least one, preferably at least two, substituents of the formula $>NR^8$ where $R^8$ represents a hydrocarbyl group containing 8 to 40 carbon atoms, which substituent or one or more of which substituents may be in the form of a cationic derivative. As examples there may be mentioned the following groups of compounds:

(a) An amine salt and/or amide obtainable by the reaction of at least one molar proportion of a hydrocarbyl substituted amine with a molar proportion of a hydrocarbyl acid having from 1 to 4 carboxylic acid groups or an anhydride thereof, the substituent(s) having the formula $>NR^8$ advantageously being of the formula $—NR^8R^9$ where $R^8$ is as defined above and $R^9$ represents hydrogen or $R^8$, provided that $R^8$ and $R^9$ may be the same or different, said substituents constituting part of the amine salt and/or amide groups of the compound.

Advantageously, ester/amides containing 30 to 300, preferably 50 to 150, total carbon atoms are used, these nitrogen compounds being described in U.S. Pat. No. 4,211,534. Preferred amines are $C_{12}$ to $C_{40}$ primary, secondary, tertiary or quaternary amines or mixtures thereof, although shorter chain amines may be used provided the resulting nitrogen compound is oil soluble. The nitrogen compound advantageously contains at least one linear $C_8$ to $C_{40}$, preferably $C_{14}$ to $c_{24}$, alkyl segment.

Secondary amines are preferred, tertiary and quaternary amines only forming amine salts. As examples of amines there may be mentioned tetradecylamine, cocoamine, and hydrogenated tallow amine. Examples of secondary amines include dioctadecylamine and methyl-behenylamine. Amine mixtures are also suitable, for example, those derived from natural materials. A preferred amine is a secondary hydrogenated tallow amine of the formula $HNR^{13}R^{14}$ wherein $R^{13}$ and $R^{14}$ are alkyl groups derived from hydrogenated tallow fat (normally composed of approximately 4% $C_{14}$, 31% $C_{16}$, 59% $C_{18}$ alkyl groups).

Examples of suitable carboxylic acids and their anhydrides for preparing the nitrogen compounds include cyclohexane-1,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactone. Generally, these acids have from 5 to 13 carbon atoms in the cyclic moiety. Preferred acids are the benzene dicarboxylic acids, phthalic acid, isophthalic acid, and terephthalic acid. Phthalic acid or its anhydride is particularly preferred. The particularly preferred compound is the amide-amine salt formed by reacting 1 molar portion of phthalic anhydride with 2 molar portions of hydrogenated tallow amine. Another preferred compound is the diamide formed by dehydrating this amide-amine salt.

Other examples are long chain alkyl or alkylene substituted dicarboxylic acid derivatives, for example the amine salts of monoamides of substituted succinic acids, examples of which are known in the art and described, for example, in U.S. Pat. No. 4,147,520. Suitable amines may be those described above.

Other examples are condensates, for example, those described in EP-A-327,423.

(b) A compound comprising a ring system, the compound carrying at least two, but preferably only two, substituents of the general formula (I) below on the ring system $$—A—NR^{15}R^{16} \quad (1)$$

where A is an aliphatic hydrocarbylene group optionally interrupted by one or more hetero atoms and that is straight chain or branched, and $R^{15}$ and $R^{16}$ are the same or different and each is independently a hydrocarbyl group containing 9 to 40, advantageously from 16 to 40, preferably from 16 to 24, carbon atoms, optionally interrupted by one or more hetero atoms, the substituents being the same or different and the compound optionally being in the form of a salt thereof. Advantageously, $R^{15}$ and $R^{16}$ are linear, and advantageously $R^{15}$ and $R^{16}$ are alkyl, alkenyl, or an alkyl-terminated mono- or poly-oxyalkylene group.

Advantageously, A contains from 1 to 20 carbon atoms and is preferably a methylene or polymethylene group.

The ring system may comprise homocyclic, heterocyclic, or fused polycyclic assemblies, or a system where two or more such cyclic assemblies are joined to one another, and in which the cyclic assemblies may be the same or different. Where there are two or more such cyclic assemblies, the substituents of the formula $—A—NR^{15}R^{16}$ may be on the same or different assemblies, but are preferably on the same assembly. Preferably, the or each cyclic assembly is aromatic, more preferably a benzene ring. Most preferably, the cyclic ring system is a single benzene ring, when it is preferred that the substituents are in the ortho or meta positions, the ring being optionally further substituted.

The ring atoms in the cyclic assembly or assemblies are preferably carbon atoms but may for example include one or more ring N, S or O atoms.

Examples of polycyclic assemblies include condensed benzene structures, e.g., naphthalene, anthracene, phenanthrene, and pyrene;

condensed ring structures containing rings other than benzene, e.g., azulene, indene, hydroindene, fluorene, and diphenylene oxides:

rings joined "end-on", e.g., diphenyl;

heterocyclic compounds e.g., quinoline, indole, 2,3-dihydroindole, benzofuran, coumarin, isocoumarin, benzothiophen, carbazole and thiodiphenylamine;

non-aromatic or partially saturated ring systems e.g., decalin (decahydronaphthalene), Ó-pinene, cardinene, and bornylene; and bridged ring structures e.g., norbornene, bicycloheptane (i.e. norbornane), bicyclooctane, and bicyclooctene.

(c) A condensate of a long chain primary or secondary amine with a carboxylic acid-containing polymer.

Specific examples include the polymers described in GB-A-2,121,807, FR-A-2,592,387 and DE-A-3,941,561; the esters of telomer acids and alkanoloamines described in U.S. Pat. No. 4,639,256; and the reaction product of an amine containing a branched carboxylic acid ester, an epoxide and a monocarboxylic acid polyester described in U.S. Pat. No. 4,631,071.

(D) Hydrocarbon polymers.

These are advantageously copolymers of ethylene and at least one Ó-olefin, having a number average molecular weight of at least 30,000. Preferably the Ó-olefin has at most 20 carbon atoms. Examples of such olefins are propylene, 1-butene, isobutene, n-octene-1, isooctene-1, n-decene-1, and n-dodecene-1. The copolymer may also comprise small amounts, e.g, up to 10% by weight of other copolymerizable monomers, for example olefins other than Ó-olefins, and non-conjugated dienes. The preferred copolymer is an ethylene-propylene copolymer. It is within the scope of the invention to include two or more different ethylene-Ó-olefin copolymers of this type.

The number average molecular weight of the ethylene-Ó-olefin copolymer is, as indicated above, at least 30,000, as measured by GPC relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 per cent. More advantageously, the ethylene content is within the range of from 57 to 80%, and preferably it is in the range from 58 to 73%; more preferably from 62 to 71%, and most preferably 65 to 70%.

Preferred ethylene-Ó-olefin copolymers are ethylene-propylene copolymers with a molar ethylene content of from 62 to 71% and a number average molecular weight in the range 60,000 to 120,000, especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble in fuel oil at low temperatures.

The additive composition may also comprise a further ethylene-Ó-olefin copolymer, advantageously with a number average molecular weight of at most 7500, advantageously from 1,000 to 6,000, and preferably from 2,000 to 5,000, as measured by vapour phase osmometry. Appropriate Ó-olefins are as given above, or styrene, with propylene again being preferred. Advantageously the ethylene content is from 60 to 77 molar per cent although for ethylene-propylene copolymers up to 86 molar per cent by weight ethylene may be employed with advantage.

(E) Hydrocarbyl esters.

As preferred materials of this type, there may be mentioned $C_8$ to $C_{32}$ hydrocarbyl esters of tertiary amine-substituted aliphatic carboxylic acids. More especially, there may be mentioned compounds of the formula $$(R^{21}R^{22}N)_e—G—(NR^{21}R^{23})f \text{ or } BNR^{21}{}_2$$

wherein G represents an (e+f) valent and B represents a monovalent hydrocarbon radical optionally interrupted by at least one heteroatom selected from oxygen and nitrogen, each $R^{21}$ independently represents $$—CHR^{24}(CHR^{25})_pCOOR^{26},$$

$R^{22}$ and $R^{23}$ each independently represent $R^{21}$, H, or an alkyl group containing from 1 to 8 carbon atoms, $R^{24}$ and $R^{25}$ each independently represent H or an alkyl group containing from 1 to 8 carbon atoms, $R^{26}$ represents a hydrocarbyl group containing from 8 to 32 carbon atoms optionally interrupted by at least one hetero atom selected from oxygen and nitrogen, e and f each represent an integer up to 12 or zero provided that the total number of $R^{21}$ groups is at least 2, and p represents zero or an integer within the range of from 1 to 4. Further details of such compounds are set out in International Application WO98/03614, the disclosure of which is incorporated by reference herein.

Advantageously, G or B represents a radical containing from 1 to 200, preferably from 2 to 65, carbon atoms. G or B may represent a saturated aliphatic radical or a radical of the formula $$—[CH(CH_3)CH_2O]_a—[CH_2CH_2O]_b—[CH_2CH(CH_3)O]_c—CH_2CH(CH_3)—,$$

where a+c is within the range of 2 to 4 and b is within the range of 5 to 100.

A preferred member of this group is a $C_{18}$ to $C_{22}$ mixed alkyl tetraester of hexane diamine tetrapropionic acid.

(F) Poly(meth)acrylate esters.

Advantageously, these materials are acrylate and methacrylate, hereinafter collectively referred to as (meth) acrylate, homo- and co-polymers. Examples of such polymers are copolymers of (meth)acrylic esters of at least two, linear or branched, alkanols containing various numbers of carbon atoms, e.g., from 6 to 40, especially copolymers of methacrylic esters of $C_{18}$ to $C_{22}$ linear alkanols, optionally together with an olefinic monomer, e.g., ethylene, or a nitrogen-containing monomer, e.g., N-vinyl pyridine or a dialkylaminoalkyl (meth)acrylate. The weight average molecular weight, as measured by GPC, of the polymer is advantageously within the range of from 50,000 to 500,000. A presently preferred polymer of this type is a copolymer of methacrylic acid and a methacrylic ester of $C_{14}/C_{15}$ saturated alcohols (1:9 molar ratio), the acid groups being neutralized with di(hydrogenated tallow) amine, this material being referred to below as Additive F.

(G) A polyoxyalkylene compound.

Examples are polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkyl group in said polyoxyalkylene glycol containing from 1 to 4 carbon atoms. These materials form the subject of EP-A-0 061 895. Other such additives are described in U.S. Pat. No. 4,491, 455.

The preferred esters, ethers or ester/ethers are those of the general formula $$R^{31}—O(L)—O—R^{32}$$

where $R^{31}$ and $R^{32}$ may be the same or different and represent (a) n-alkyl—

(b) n-alkyl-CO—

(c) n-alkyl-O—$CO(CH_2)_x$— or (d) n-alkyl-O—$CO(CH_2)_x$—CO— x being, for example, 1 to 30, the alkyl group being linear and containing from 10 to 30 carbon atoms, and L representing the polyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be present but it is preferred that the glycol is substantially linear. L may also contain nitrogen.

Examples of suitable glycols are substantially linear polyethylene glycols (PEG) and polypropylene glycols (PPG) having a molecular weight of from 100 to 5,000, preferably from 200 to 2,000. Esters are preferred and fatty acids containing from 10–30 carbon atoms are useful for reacting with the glycols to form the ester additives, it being preferred to use a $C_{18}$–$C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred for use in narrow boiling distillates, when minor amounts of monoethers and monoesters (which are often formed in the manufacturing process) may also be present. It is preferred that a major amount of the dialkyl compound be present. In particular, stearic or behenic diesters of polyethylene glycol, polypropylene glycol or polyethylene/polypropyleneglycol mixtures are preferred.

Other examples of polyoxyalkylene compounds are those described in Japanese Patent Publication Nos. 2-51477 and 3-34790, and the esterified alkoxylated amines described in EP-A-117,108 and EP-A-326,356.

(H) A saturated hydrocarbon mixture.

Advantageously, the saturated hydrocarbon mixture, component (H), comprises normal (linear) alkanes. Advantageously, the mixture has a boiling range from about 230 to 510° C. Advantageously, the mixture contains a spread of at least 16 carbon atoms from the lowest to the highest carbon number. Preferably, the mixture contains a substantial proportion of $C_{24}$ to $C_{32}$, more preferably a substantial proportion of $C_{24}$ to $C_{28}$, hydrocarbons, by weight. Advantageously, the number average molecular weight is in the range of 350 to 450. Advantageously, the mixture is a wax.

Waxes have conventionally been defined by reference to their physical characteristics, in view of the large and varied number of hydrocarbon components which they contain, and the difficulties in separating such closely related, and often homologous, hydrocarbon molecules. "Industrial Waxes", H. Bennett, 1975, describes the different types of petroleum wax and indicates that the characteristics of melting point and refractive index have proved useful in classifying the variety of waxes available from different sources. Waxes are also typically described in terms of their n-alkane content.

When component (H) is a mixture of mixtures, especially two or more mixtures of normal and non-normal alkanes, this may be apparent from chromatographic characterization, which would show a bi- or multi-modal distribution of carbon numbers. In general, an n-alkane wax has a maximum in the carbon number distribution at a lower carbon number than does a non n-alkane wax.

The wax may be an n-alkane wax or non n-alkane wax. The term "n-alkane wax" is used in this specification to mean a wax which comprises 40% or more n-alkanes by weight, based on the total weight of that wax. Similarly, the term, "non n-alkane wax" is used in this specification to mean a wax which comprises less than 40% n-alkanes by weight, based on the total weight of that wax. Preferably, an n-alkane wax contains at least 55%, more preferably at least 60%, n-alkanes by weight. Preferably, a non n-alkane wax contains less than 35%, more preferably less than 30%, for example less than 20% or 15%, n-alkanes by weight.

More preferably, the n-alkane wax is a slack wax, for example, a slack wax obtained from dewaxing of heavy gas oils having viscosities equivalent to the lubricant viscosity ranges of 90 neutral to 400 neutral, for example: slackwax 90 neutral, slackwax 130 neutral, slackwax 150 neutral and slackwax 400 neutral. Such waxes normally comprise a range of hydrocarbon components containing between 15 and 60 carbon atoms, with the n-alkane distribution typically being n-$C_{15}$ to n-$C_{50}$, for example, n-$C_{15}$ to n-$C_{45}$.

Further examples of n-alkane waxes suitable for use in this invention include the various grades of "Shell wax", particularly Shellwax 130/135 and 125/130.

The non n-alkane wax may be a slackwax derived from a heavier viscosity stream (for example, slackwax 600 neutral) or a petrolatum or foots oil material.

The non n-alkane wax is preferably one having a melting point of 42 to 59° C. and a refractive index of 1.445 to 1.458. (Refractive index as used in this specification is measured according to ASTM D1747-94, at a temperature of 70° C.)

The melting point of a non n-alkane wax useful in the present invention is advantageously in the range of 44° C. to 55° C., preferably 45° C. to 53° C., and more preferably 47° C. to 53° C. Melting point as used in this specification is measured according to ASTM D938.

The refractive index of a wax useful in the present invention is preferably in the range of 1.445 to 1.455, more preferably in the range of 1.447 to 1.454, and most preferably in the range of 1.445 to 1.453, particularly in the range of 1.451 to 1.453.

Particularly suitable non n-alkane waxes have the following combinations of melting point and refractive index, measured according to the above-defined tests:

(i) advantageously a melting point in the range of 42° C. to 59° C. and a refractive index in the range of 1.445 to 1.455;

(ii) preferably a melting point in the range of 44° C. to 55° C. and a refractive index in the range of 1.447 to 1.454;

(iii) more preferably a melting point in the range of 45° C. to 53° C. and a refractive index in the range of 1.445 to 1.453; and (iv) most preferably a melting point in the range of 47° C. to 53° C. and a refractive index in the range of 1.451 to 1.453.

Surprisingly, it has been found that mixtures of different petroleum waxes have properties particularly useful for improving the low temperature flow properties of oils, and especially fuel oils, e.g., middle distillate fuel oils. Whilst not wishing to be bound by any particular theory, it is postulated that wax mixtures possess a combination of components which interact very favourably with precipitating n-alkanes present within the oil and with any further low temperature flow improver also present in the oil, such that the detrimental effects of precipitation of the wax inherent in the oil are reduced or even prevented.

Mixtures of two or more such waxes may show better performance in low temperature flow improver applications than a single wax.

Preferred wax mixtures are those in which at least one wax is an n-alkane wax and at least one wax is a non n-alkane wax.

Additives comprising one or more n-alkane slack waxes with one or more of the above forms of wax (i) to (iv) are particularly advantageous as flow improver compositions.

In a mixture of waxes, more than one of each type of wax may be used with advantage.

The different waxes used according to this invention are typically obtained by appropriate separation and fractionation of different wax-containing distillate fractions, and are available from wax suppliers.

While certain types of cold flow improvers, for example the mixtures of saturated hydrocarbons in category (H), do not present severe compatibility problems with hydrogenated diene polymers, the problem is particularly severe with the copolymers of category (A). The improvement in compatibility obtained by the incorporation of a polar group in the diene polymer is accordingly especially valuable when a category (A) copolymer is present, and the present invention more especially provides a cold flow improver additive comprising (i) a hydrogenated diene polymer having a polar group and (ii) an ethylene-unsaturated ester copolymer, the composition optionally also containing one or more other cold flow additives, especially one or more of those in categories (B) to (H) above, and more especially a mixture of saturated hydrocarbons of category H.

As used in this specification the terms "hydrocarbyl" and hydrocarbylene refer to a group having a carbon atom directly attached to the rest of the molecule and having a hydrocarbon or predominantly hydrocarbon character. Among these, there may be mentioned hydrocarbon groups, including aliphatic, (e.g., alkyl or alkenyl), alicyclic (e.g., cycloalkyl or cycloalkenyl), aromatic, aliphatic and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred. Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulfur, and, preferably, oxygen. Advantageously, the hydrocarbyl group contains at most 30, preferably at most 15, more preferably at most 10 and most preferably at most 8, carbon atoms.

The composition may contain two or more components (i), and two or more components (ii). The components (ii) may come from the same category, of A to H, or different categories.

The invention also provides an oil containing the additive composition, and an additive concentrate comprising the additive composition in admixture with an oil or a solvent miscible with the oil. The invention further provides the use of the additive composition to improve the low temperature properties of an oil. The oil may be a crude oil, i.e. oil obtained directly from drilling and before refining, the compositions of this invention being suitable for use as flow improvers therein.

The oil may be a lubricating oil, which may be an animal, vegetable or mineral oil, such, for example, as petroleum oil fractions ranging from naphthas or spindle oil to SAE 30, 40 or 50 lubricating oil grades, castor oil, fish oils or oxidized mineral oil. Such an oil may contain additives depending on its intended use; examples are viscosity index improvers such as ethylene-propylene copolymers, succinic acid based dispersants, metal containing dispersant additives and zinc dialkyl-dithiophosphate antiwear additives. The compositions of this invention may be suitable for use in lubricating oils as flow improvers, pour point depressants or dewaxing aids.

The oil may be a fuel oil, especially a middle distillate fuel oil. Such distillate fuel oils generally boil within the range of from 110° C. to 500° C., e.g. 150° to 400° C.

The invention is applicable to middle distillate fuel oils of all types, including the broad-boiling distillates, i.e., those having a 90%–20% boiling temperature difference, as measured in accordance with ASTM D-86, of 100° C. or more and an FBP-90% of 30° C. or more, and more especially to the more difficult to treat narrow boiling distillates, having a 90%–20% boiling range of less than 100° C., especially of less than 85° C.

The fuel oil may comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or it may contain minor amounts, e.g. up to 35 wt %, of vacuum gas oil or cracked gas oils or of both.

The invention is also applicable to vegetable-based fuel oils, for example rape seed oil, used alone or in admixture with a petroleum distillate oil.

The additive should preferably be soluble in the oil to the extent of at least 1000 ppm by weight per weight of oil at ambient temperature. However, at least some of the additive may come out of solution near the cloud point of the oil and function to modify the wax crystals that form.

In addition, the additive composition and the fuel oil composition may contain additives for other purposes, e.g., for reducing particulate emission or inhibiting colour and sediment formation during storage.

The fuel oil composition of the invention advantageously contains the additive of the invention in a total proportion of 0.0005% to 2.5%, preferably 0.01% to 0.25% by weight, based on the weight of fuel.

Components (i) and (ii) are advantageously present in a weight ratio of from 1:15 to 1:1, preferably from 1:10 to 1:3. When component (ii) is a copolymer of category (A), the composition advantageously contains components (i), (A), and (H), and preferably in a proportion between 1:15 to 1:0 to 2, respectively.

The following Examples, in which parts and percentages are by weight, illustrate the invention:

The following fuels were used in the Examples

| | Fuel 1 | Fuel 2 |
|---|---|---|
| Cloud Point, ° C. | −9 | −7.2 |
| CFPP, ° C. | −9.5 | −8 |
| IBP, ° C. | 172 | 173 |
| FBP, ° C. | 357 | 365 |
| 90–20, ° C. | 99 | 115 |
| FBP-90, ° C. | 25 | 30 |
| WAT, ° C. | −7.4 | −13 |
| % Wax at 5° C. below Cloud Point | 1.16 | — |
| At 10° C. below | 2.17 | 1.09 |

CFPP is measured as described in "Journal of the Institute of Petroleum", 52 (1966), 173.

Examples 1 and 2 and Comparative Examples A & B

In these examples, compositions comprising (i) a hydroxylated polyethylene-poly(ethylene-butene) (PEPEB) material, molar ratio 1.5:5, (A) an ethylene-vinyl acetate copolymer, vinyl acetate content 11% (molar) Mn 3000 to 5000, degree of branching 5 $CH_3$ groups per 100 $CH_2$ and (H) a mainly non-alkane wax, were tested for stability, and compared with reference compositions in which the PEPEB was not hydroxylated. The compositions were tested at 60° C. at a total concentration of 65% in Solvesso (trade mark) 150. The results were as follows.

| Example | Ratio of Components (i):A:H | Stable up to |
|---|---|---|
| A | 1:4:1 | 24 hours |
| 1 | 1:4:1 | 28 days |
| B | 1:9:1 | 7 days |
| 2 | 1:9:1 | 28 days |

Examples 3 and 4 and Comparative Examples C and D

In these examples, the CFPP's of two fuels comprising the same hydroxylated PEPEB and ethylene-vinyl acetate copolymer as used in the previous examples were compared with those of the same fuels with the unhydroxylated PEPEB and copolymer as before. The weight ratio of PEPEB to copolymer was 1:9.

The results show that hydroxylation of the PEPEB does not adversely affect the cold flow improver performance.

| | | CFPP, ° C., at treat rate: | | |
|---|---|---|---|---|
| Example | Fuel | 100 ppm | 200 ppm | 400 ppm |
| C | 1 | −14.7 | −22 | −24.3 |
| 3 | 1 | −12.5 | −21 | −25 |
| D | 2 | −20 | −27 | −28.5 |
| 4 | 2 | −19.5 | −25 | −28.5 |

What is claimed is:

1. A cold flow improver additive composition comprising (i) a hydrogenated diene polymer having a polar group and (ii) a cold flow improver other than a polymer (i).

2. A composition as claimed in claim 1, wherein the hydrogenated polymer contains at least one crystallizable or crystalline block and at least one non-crystallizable or non-crystallizable block.

3. A composition as claimed in claim 1, wherein the hydrogenated polymer is obtainable by hydrogenation of a block copolymer comprising units derived from butadiene and at least one comonomer of the formula $$CH_2{=}CR^1{-}CR^2{=}CH_2$$

wherein $R^1$ represents a $C_1$ to $C_8$ alkyl group and $R^2$ represents hydrogen or a $C_1$ to $C_8$ alkyl group.

4. A composition as claimed in claim 3, wherein the comonomer contains from 5 to 8 carbon atoms.

5. A composition as claimed in claim 3, wherein the comonomer is isoprene.

6. A composition as claimed in claim 1, wherein the hydrogenated diene polymer is obtainable by hydrogenation of a polymer comprising units derived from 1,2 enchainment of butadiene and units derived from 1,4 enchainment of butadiene.

7. A composition as claimed in claim 1, wherein the molecular weight, Mw, measured by GPC, of component (i) is within the range of 500 to 100,000.

8. A composition as claimed in claim 7, wherein the molecular weight is within the range of 3,000 to 8,000.

9. A composition as claimed in claim 1, wherein the hydrogenated diene polymer is a diblock copolymer comprising a crystalline block and a non-crystalline block, the molecular weight of the crystalline block being from 500 to 20,000 and that of the non-crystalline block from 500 to 50,000.

10. A composition as claimed in claim 1, wherein the hydrogenated diene polymer is a tapered block copolymer.

11. A composition as claimed in claim 1, wherein at least 90% of the original unsaturation of the diene polymer of component (i) has been removed by hydrogenation.

12. A composition as claimed in claim 1, wherein the polar group in polymer (i) is a terminal group.

13. A composition as claimed in claim 1, wherein the polar group is a hydroxy group.

14. A composition as claimed in claim 1, wherein the polar group is present in a proportion of 0.4 to 2 groups per polymer molecule.

15. A composition as claimed in claim 14, wherein the polar group is present in a proportion of 0.8 to 1.2 groups per polymer molecule.

16. A composition as claimed in claim 1, wherein component (ii) comprises an ethylene-unsaturated ester copolymer.

17. A composition as claimed in claim 16, wherein the copolymer is an ethylene-vinyl ester copolymer.

18. A composition as claimed in claim 17, wherein the copolymer is an ethylene-vinyl acetate copolymer.

19. A composition as claimed in claim 17, wherein the copolymer is a terpolymer of ethylene, vinyl acetate, and a vinyl ester of a $C_2$ to $C_{10}$ alkane carboxylic acid.

20. A composition as claimed in claim 19, wherein the alkanecarboxylic acid is 2-ethylhexanoic acid.

21. A composition as claimed in claim 16, wherein the copolymer has a molecular weight of at most 20000 and a molar ester content of at least 7.5 per cent.

22. A composition as claimed in claim 1, wherein component (ii) comprises a mixture of saturated hydrocarbons, at least some of which have a number of carbon atoms within the range of 15 to 60.

23. A composition as claimed in claim 1, wherein component (ii) has a boiling range from 230 to 510° C.

24. A composition as claimed in claim 1, wherein component (ii) contains a range of at least 16 carbon atoms from the lowest to the highest carbon number.

25. A composition as claimed in claim 1, wherein the average molecular weight of component (ii) is within the range of from 350 to 450.

26. A composition as claimed in claim 1, wherein component (ii) is a wax.

27. A composition as claimed in claim 26, wherein the wax is an n-alkane wax.

28. A composition as claimed in claim 1, wherein component (ii) comprises a polar nitrogen compound.

29. A composition as claimed in claim 28, wherein component (ii) is the reaction product of phthalic anhydride and two molar equivalents of secondary hydrogenated tallow amine.

30. A composition as claimed in claim 1, additionally comprising component (iii), wherein component (iii) comprises a (meth)acrylate homo- or co-polymer.

31. A composition as claimed in claim 1 additionally comprising component (iii), wherein component (iii) comprises a comb polymer.

32. A composition as claimed in claim 31, wherein the comb polymer is a copolymer of vinyl acetate and a fumarate ester.

33. A composition as claimed in claim 1, wherein component (ii) comprises a polyoxyalkylene ester, ether, ester/ether, amide/ester, or a mixture of two or more thereof.

34. A composition as claimed in claim 1, wherein component (ii) comprises a $C_8$ to $C_{32}$ hydrocarbyl ester of a tertiary amine-substituted aliphatic carboxylic acid.

35. A composition as claimed in claim 1, wherein component (ii) comprises a hydrocarbon polymer.

36. A composition as claimed in claim 1, which comprises two or more components (i).

37. A composition as claimed in claim 1, wherein component (ii) comprises an ethylene-vinyl acetate copolymer and a mixture of saturated hydrocarbons.

38. A composition as claimed in any one of claims 1 to 37, wherein component (ii) comprises an ethylene-vinyl acetate copolymer and a mixture of saturated hydrocarbons.

39. A fuel or lubricating oil composition comprising a lubricating or fuel oil and an additive composition as claimed in claim 1.

40. A composition as claimed in claim 39, which contains the additive in a total proportion of from 0.01 to 0.25% by weight, based on the weight of oil.

41. An additive concentrate comprising the additive composition as claimed in claim 1 in an oil or a solvent miscible with oil.

42. A method for improving the cold flow properties of a fuel or lubricating oil comprising adding to the oil a composition comprising: (i) a hydrogenated diene polymer having a polar group and (ii) a cold flow improver other than a polymer (i).

43. In a composition for improving the cold flow properties of a fuel or lubricating oil in which the composition comprises a diene polymer cold flow improver with a cold flow improver other than the diene polymer, the improvement comprising utilizing as the diene polymer cold flow improver a hydrogenated diene polymer having a polar group.

* * * * *